US005630336A

United States Patent [19]

Jorgenson

[11] Patent Number: 5,630,336

[45] Date of Patent: May 20, 1997

[54] BENDING BRAKE

[76] Inventor: Jerry N. Jorgenson, 6692 Gerdine Path W., Rosemount, Minn. 55068

[21] Appl. No.: 488,555

[22] Filed: Jun. 7, 1995

Related U.S. Application Data

[63] Continuation of Ser. No. 915,906, Jul. 17, 1992, abandoned.

[51] Int. Cl.[6] ..... B21D 5/04

[52] U.S. Cl. ..... 72/319

[58] Field of Search ..... 72/319–323

[56] References Cited

U.S. PATENT DOCUMENTS

| | | | |
|---|---|---|---|
| 343,701 | 6/1886 | Cortright | 72/323 |
| 437,829 | 10/1890 | Born | 72/319 |
| 929,818 | 8/1909 | Benelek | 72/319 |
| 1,283,808 | 11/1918 | Krump | 72/319 |
| 1,761,888 | 6/1930 | Junkers | 72/310 |
| 1,806,986 | 5/1931 | Rucker | 72/321 |
| 2,028,869 | 1/1936 | Jensen | 72/319 |
| 2,208,061 | 7/1940 | Warger | 72/321 |
| 2,302,958 | 11/1942 | Jensen | 72/319 |
| 3,301,034 | 1/1967 | Boettcher | 72/321 |
| 4,052,948 | 10/1977 | Straza et al. | 72/310 |
| 4,112,731 | 9/1978 | Anderson | 72/320 |

FOREIGN PATENT DOCUMENTS

| | | | |
|---|---|---|---|
| 2336992 | 7/1977 | France | 72/319 |
| 270460 | 5/1970 | U.S.S.R. | 72/319 |
| 1548707 | 7/1979 | United Kingdom | 72/319 |

*Primary Examiner*—Daniel C. Crane
*Attorney, Agent, or Firm*—Robert C. Baker

[57] ABSTRACT

The new bending brake comprises three basic assemblies, namely a base assembly having an upward brake surface, a cover assembly having a downward brake surface above the base assembly, and an apron assembly pivotally hinged to the base assembly and having an upward brake surface. The brake surface of each of these assemblies comprises an alignment of a plurality of movable table segments that can be moved in the linear direction of the alignment and fixed against such linear movement. A support system subordinate to the brake surfaces of the table segments includes a mounting rod on which the linearly movable table segments are mounted for independent linear movement. The support system also includes foundation rods carrying elevation and horizontal adjustment members for group adjustment of the table segments with respect to the axis of bend of the brake. The cover assembly is pivotally hinged at one end to the base assembly and equipped with a latching mechanism at the other. An adjustable stop governs the degree of bend for the brake, and measuring rods assure consistent sheet location for repeat bends.

30 Claims, 4 Drawing Sheets

BENDING BRAKE

This is a continuation of application Ser. No. 07/915,906, filed Jul. 17, 1992, now abandoned.

BACKGROUND OF THE INVENTION

This invention relates to a versatile bending brake capable of being relatively easily ported or moved from one site to another and easily adjusted for varied bending operations. The invention also relates to a method of preparing the new brake for on-site bending operations.

The on-site bending of metal or metal-like construction panels (including apparatus panels) in an accurate manner to satisfy the precision desired by designers and architects and owners has been a vexing problem. The problem is especially acute for roofers. Ingenious standing seam roof designs generally require varied styles of angular bends in the roofing panels. These bends are usually along a line perpendicular to the upstanding flanged edges of a length of the roofing panel. The upstanding flanges themselves normally are preliminarily cut at the precise intersection location for an expected transverse line of bend. Using prior art on-site techniques for the bending-such as bending roofing panel over wooden blocks-rarely has resulted in neat angular bends of uniform line and angle character across the width of the panel. Too frequently the center portion of the transverse bend is relatively curved in its bend, as compared to a relatively more sharp and angular bend at or near the edges (i.e., near the side flange cuts). When a multitude of panels are to be bent to the same degree at the same relative panel length location, the imperfection of bends formed by existing on-site techniques is especially noticeable.

Bending brakes, of course, have been available for many years, but have been massive, heavy, and relatively immobile. Insofar as is known, no bending brake heretofore has possessed the needed simplicity and versatility and portability for movement to a roof or other construction location for convenient on-site bending as well as on-site modification of brake surface configurations to accomplish varied bending. The formation of precise on-site bends in architectural sheet metal panels having upward or downward protrusions (as in Batten Seam and Tee Panels) has been a vexing and unsolved problem. This invention presents the art with a solution to that long-standing on-site bending problem.

SUMMARY OF THE INVENTION

The invention provides a new type of bending brake wherein at least one of the brake surfaces comprises an alignment of a plurality of table segments capable of being moved in the linear direction of the alignment. This new way of moving segments permits extraordinary compactness of design for a brake having brake surface adjustability to create varied spacing and open areas for flanges or other projections of a panel or sheet to be bent.

Brakes according to the invention have at least three assemblies, namely a base assembly having an upward brake surface, a cover assembly having a downward brake surface above the base assembly, and an apron assembly pivotably hinged to the base assembly and having an upward brake surface. At least one of these brake surfaces has an alignment of a plurality of linearly movable table segments. Ideally, the table segments are mounted on a support or mounting rod for linear movement. Options are provided for fixing the segments against movement. For example, a fixing or set screw threaded in segments may be employed, or the pressure of an elongated abutment member on the segments may be relied upon. According to the invention, a foundation support rod or rods for the table segments may be provided with adjustment members for varying the elevation and the transverse position of the table segments. The adjustment members may act through floating elongated abutment members upon an abuttable surface of table segments in effecting elevation and horizontal variation of the table segments.

The more ideal brakes of the invention are designed to have a cover assembly hinged at one end and latched at the other, and in addition, counterbalanced for easy movement from a clamping relationship to the base assembly to an open relationship for easy placement and removal of panels in bending operations.

The invention still further provides, in combination with a bending brake, a measuring system for consistently bending panels at an equal distance from one end. A stop system is also provided for forming bends of equal angularity in different panels.

A preferred feature of the new brake is that of easy separation of its major components, such as the base assembly, cover assembly, apron assembly, and counterbalance system for greater ease of transport of the brake to different locations, especially to elevated locations on roofs. However, the bending brake of the invention, even when entirely assembled, is comparatively easily moved from location to location.

A method for preparing the brake for on-site bending comprises transporting the brake to the bending site, moving one or more table segments in a linear direction to adjust the configuration of the brake surface of at least one assembly of the brake, and fixing the table segments in that configuration against movement.

These and still other features and advantages and benefits of the invention will be evident as this description proceeds.

DESCRIPTION OF THE PREFERRED EMBODIMENT

Figure 1:
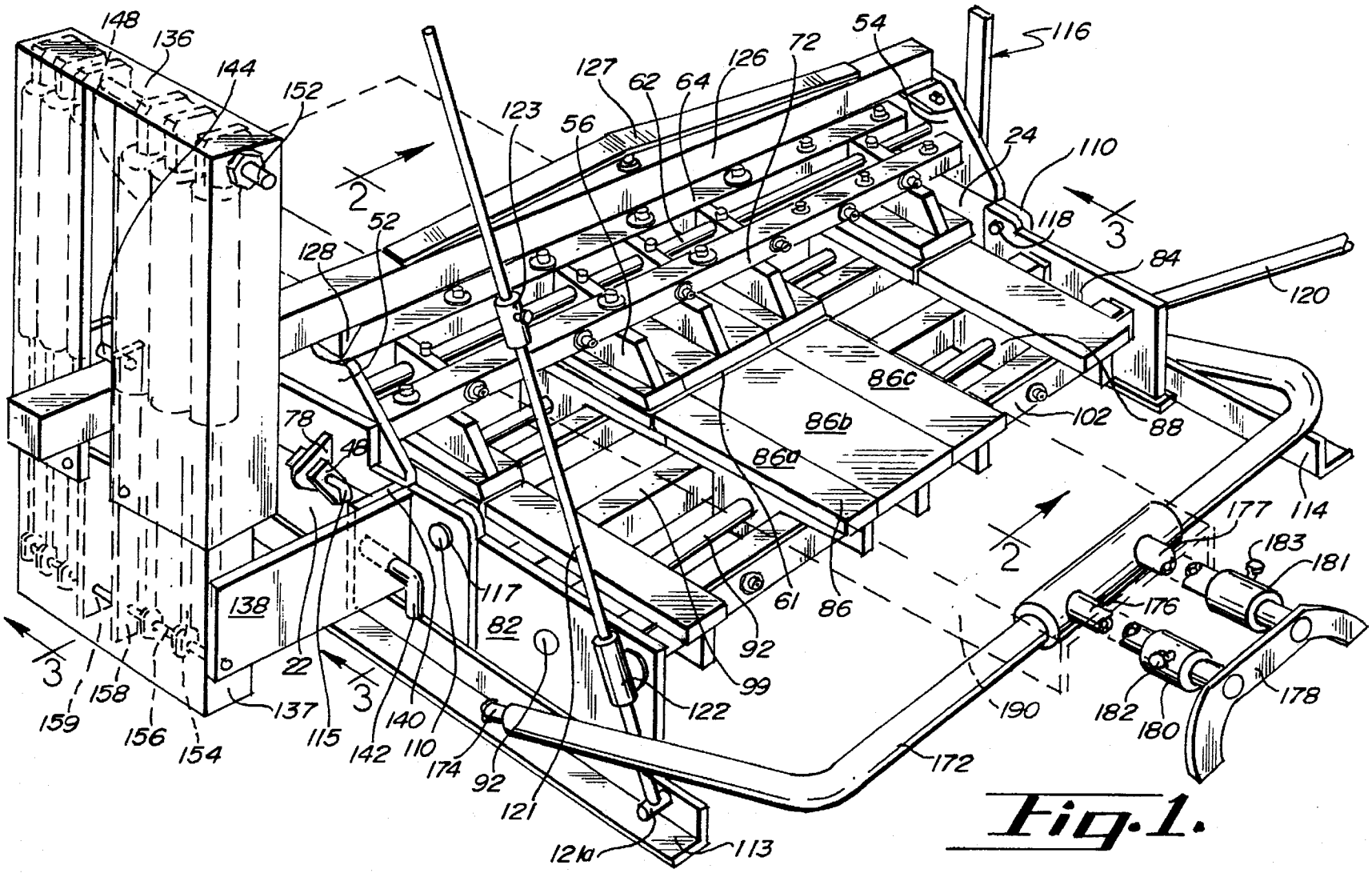
FIG. 1 is a schematic perspective view of a preferred embodiment of the new bending brake of this invention, with some portions broken away, with internal elements of a counterbalance system shown in phantom, and with a length of laterally flanged roofing panel shown in phantom.
Figure 2:
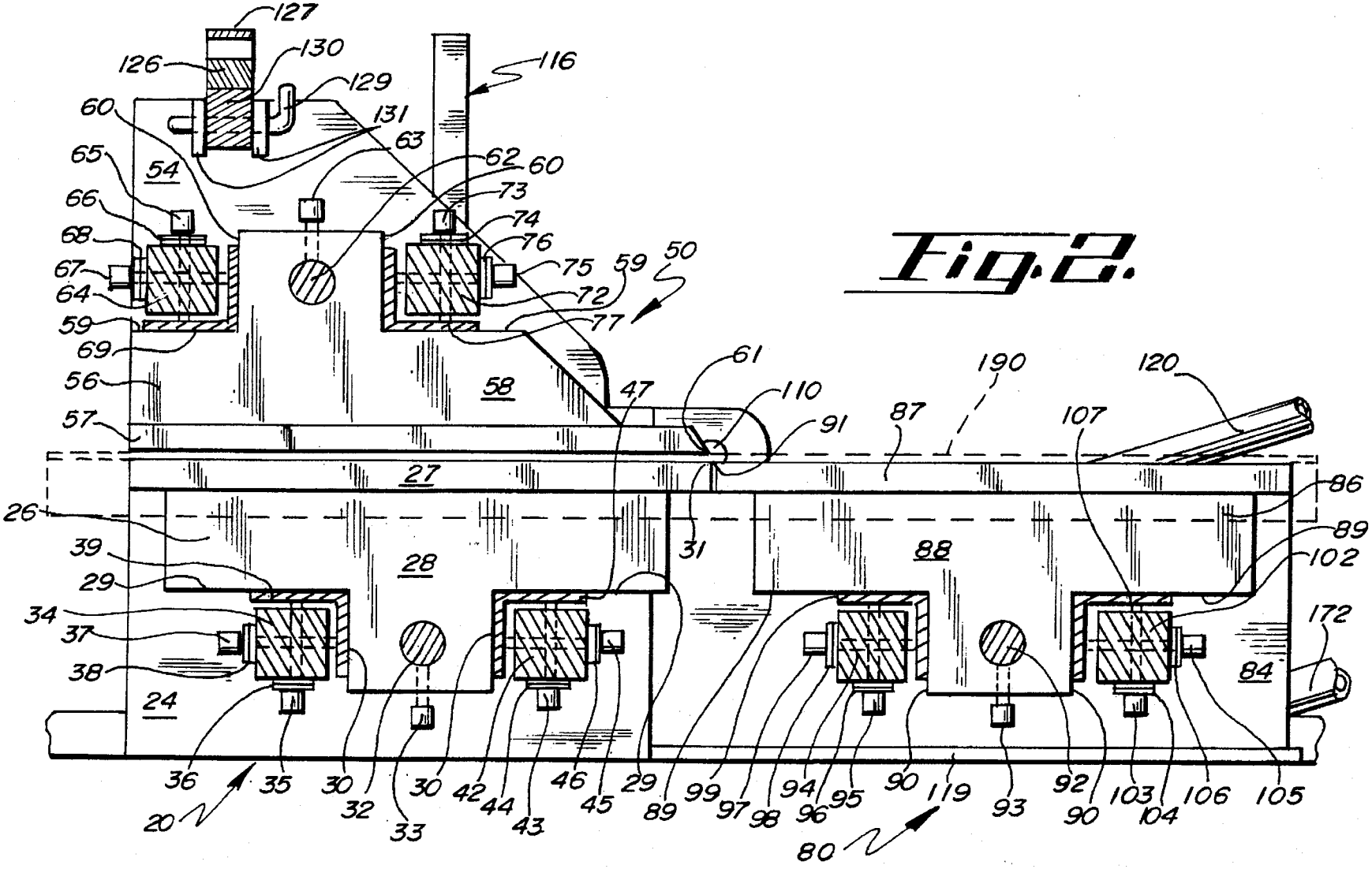
FIG. 2 is a schematic cross section taken on line 2—2 of FIG. 1, particularly illustrating in greater detail the preferred support system in the base assembly, cover assembly, and apron assembly for the table segments of each such assembly.
Figure 3:
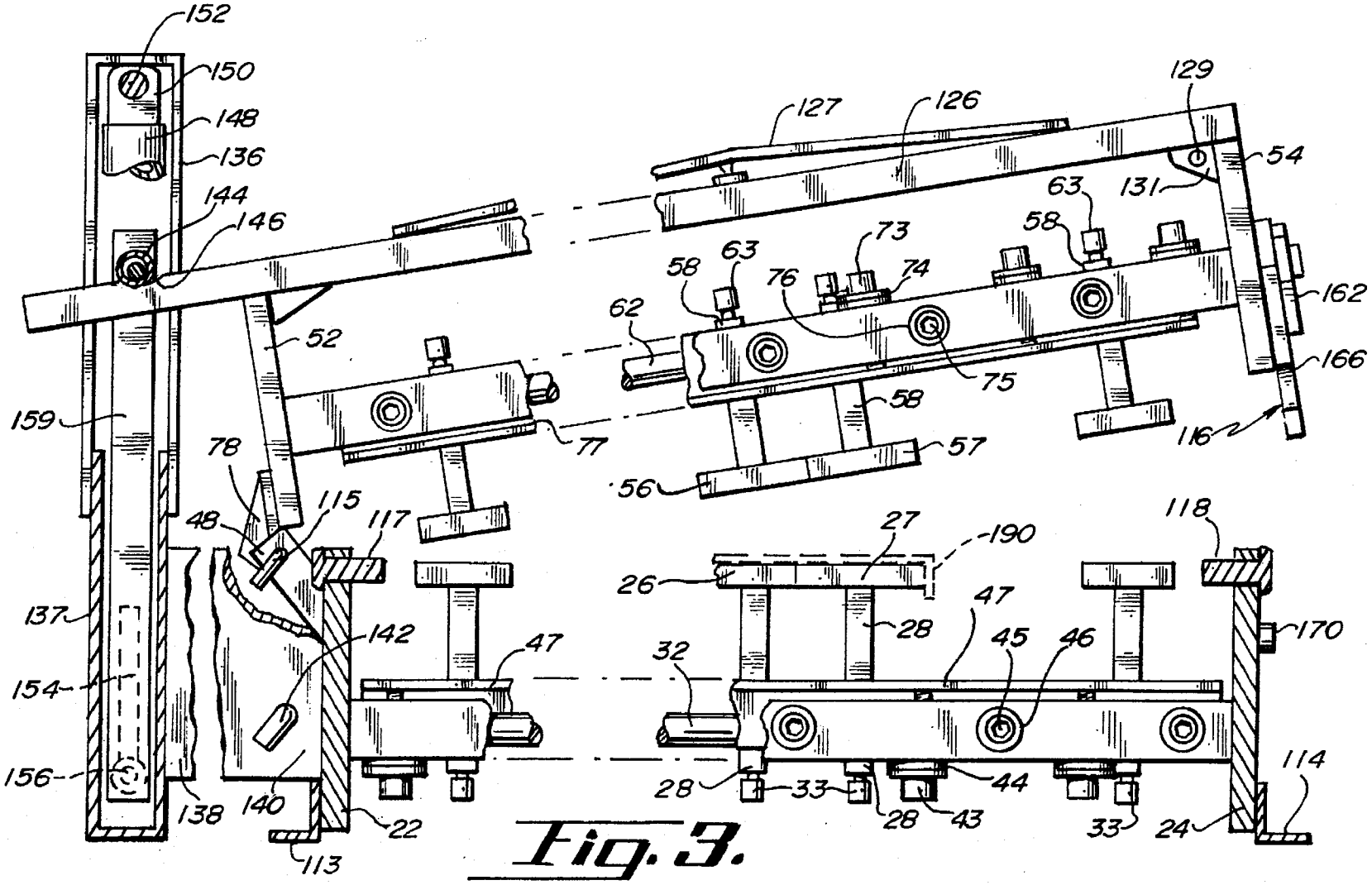
FIG. 3 is a schematic view taken approximately on line 3—3—3 of FIG. 1, (about midway through the counterbalance system and then shifting forward for the frontal portions of the base and cover assemblies, with the apron assembly entirely removed), with parts broken away to permit greater clarity of showing, and with the cover assembly pivoted upwardly in angular relationship to the base assembly.

Referring to the drawings, and particularly to FIGS. 1, 2, and 3, the new bending brake of this invention has a main axis of bend 110 and three basic portions. The three basic portions are marked in FIG. 2 as the base assembly 20, the cover assembly 50, and the apron assembly 80. Each assembly is illustrated as having several similar structural features, and for that reason, detailed description of the structural features of one assembly will be made followed by relatively summary description for the other two. It is emphasized, however, that while the illustrated structural features for the three basic assemblies preferably are similar, it is not critical to the commercial practice of the invention that the structural features of each assembly be the same or similar. A key feature of the invention is the movability of table segments in the linear direction of their alignment. A variety of ways are effective for this feature. Further, this feature in but one of the assemblies provides benefits heretofore unrealized, including compactness of design for a versatile adjustable brake surface.

The base or bed assembly 20, best shown in FIGS. 2 and 3 but having limited parts visible also in FIG. 1, is selected for the initial detailed description. The base assembly has a near end 22 and a remote end 24, each suitably plate-like in character. These ends define the length of the composite base assembly. Between these ends are a plurality of table segments 26. Each such segment is a discrete table. Illustratively, each table segment may be comprised of a top plate 27 (in generally horizontal orientation) unified to a perpendicular leg plate 28 (in generally vertical orientation). The table segments are in an alignment, and the base assembly comprises an alignment of a plurality of table segments for forming the brake surface of the assembly.

A brake surface may be formed of table segments not pressing on sheet material in a specific bending operation as well as the table segments which do press on sheet material in a specific bending operation. Sometimes it is convenient to refer to the segments actually pressing on sheet material in a specific bending operation as the "action" or "active" brake segments or surface.

Significantly, at least a majority—and, in fact, preferably all—of the discrete table segments 26 are individually movable in the linear direction of the alignment of them between the near 22 and remote 24 end plates of the base assembly. Therefore, the number of table segments making up or forming the operable action brake surface of the base assembly for a specific bending operation can be easily varied. The number can be easily varied simply by shifting segments away from or toward the portion—most preferably the mid or center portion between ends 22 and 24—selected for the specific action of pressing on sheet material in a specific bending operation. The structure of the subordinate support system for the segments functions as a holder for segments moved out of the way and not needed for a specific bending operation.

The length of the table segments 26 is in the linear direction between near end plate 22 and the remote end plate 24. Thus the length is in the linear direction of their alignment, and that length may vary for each table segment. One should note that this length for table segments may be called the "bite" of them since each segment at its brake surface has a length which functions as a bite. Different segments may have a bite of different size (i.e., in the length dimension of the base assembly). It is also important to note that the length of table segments is frequently less than their front-to-back width. (This terminology is chosen to be consistent with the terminology where length refers to distance between ends 22 and 24. Thus, the term "width-"necessarily must refer to distances perpendicular to or transverse to the length.) The longer table segments (along length direction) may be equipped with more than one leg 28.

The table segments are mounted on an elongated support system, and this is suitably accomplished by using the leg portion 28 of the segments as the base for the mounting of them.

The leg or legs 28 of each table segment suitably may take the shape of a T as viewed down the linear direction of their alignment (which is the same as the length direction of the assembly). This is the view illustrated in FIG. 2. Each leg is provided with a hole for receipt of the support rod 32. Support rod 32 is mounted to or on end plates 22 and 24. It is most preferably lodged (preferably slidably removably lodged) in snug openings or holes extending through each end plate 22 and 24; illustratively, see the FIG. 1 showing of the apron assembly center support rod 92 removably lodged in near end plate 82 of the apron assembly. (This form of fabrication permits easy sliding removal and re-insertion of the support rod 32, and change of the shape and style of table segments, including the shape and style of their brake surfaces as well as their bite size.)

The support rod 32 extends through the table segments suitably at their legs 28 and functions more or less as the base mounting rod of the table segment support system. In this connection, the legs 28 most preferably are provided with an opening or hole having a shape conforming substantially to the cross-sectional shape of the mounting support rod 32. A snug but slidable relationship between rod 32 and legs 28 is preferred. A fixing screw 33 is threaded in each support leg 28. These screws are in perpendicular relationship to the mounting rod 32 and may be screwed firmly to abut against the mounting rod 32 so as to hold their respective table segment in a particular location along the length of the mounting rod. Simple relaxation or unthreading of the screw 33 permits slidable shift of the table segment along the mounting rod to a desired location. The mounting rod 32 may have a noncircular or square or star-shaped cross section to assist in maintaining the brake surface (top surface) of the table segments in a desired generally horizontal orientation.

A preferred system for maintaining the brake surface in a generally horizontal orientation and providing for elevation and horizontal adjustment of table segments as a group with respect to the axis of bend 110 comprises lateral foundation support rods 34, 42 spaced on each side of and extending parallel to the central support rod 32. The foundation support rods 34 and 42 are fixed (as by welding) to end plates 22 and 24. These lateral rods suitably take the cross-sectional form of a square or rectangle, although this is not critical, and is clearly optional when abutment surfaces of angle iron style are employed, as illustrated. What is of significance in the most preferred structure is that the support rods 34 and 42 on each lateral side function as the foundation or base for making special adjustments not only in the height or elevation of table segments 26 relative to the main axis of bend 110, but also in the horizontal sideways or transverse shift of the table segments either toward or away from the main axes 110.

Since the table legs 28 are formed to be of substantially identical shape as viewed from the ends of the assembly (as in FIG. 2), an especially convenient way for placing or keeping the front edge 31 of the table segments in alignment for a bending operation involves the use of floating elongated abutment members 39 and 47. These members are parallel and proximate to the lateral support rods of the composite support rod system. The ideal elongated abutment members are right angle members 39 and 47, commonly referred to as angle irons. The angle irons press abuttable surfaces 29 and 30 of the angular (right angle) recesses in the legs 28. They are movable either vertically or sideways with respect to the base mounting support rod 32 as well as the laterally spaced foundation support rods 34 and 42. The angle irons (i.e., elongated abutment members) preferably float. They should not be rigidly fixed to either end plate 22 or 24 or to any other structure.

Elevational adjustment of table segments is accomplished by adjusting the several elevational abutment screws 35 and 43 lodged in threaded manner in the foundation support rods 34 and 42. The tightening of the elevational abutment members 35 and 43 abuts them against the horizontal flange of the angle irons 39 and 47 and abuts that flange in pressing fashion against the horizontal abuttable surface 29 within each angular (right angle) recess of the table leg. Such tightening in turn causes incremental elevation of the table segments. Further, when the center mount rod 32 fits closely or relatively snugly (but slidably) in segments 26 and end plates 22 and 24, the tightening of the elevational abutment screws 35 and 43 puts greater and greater stress or tension on the center mount rod 32 from the foundation rods 34 and 42. This is because the relatively snugly fitted mounting rod 32 in end plates 22 and 24 is stressed or strained vertically relative to foundation rods 34 and 42 as the table segments 26 are incrementally elevated by the elevational adjustment screws 35 and 43. (Notable is the fact that the floating elongated abutment members [angle irons] as well as a mounting rod removably lodged in end plates 22 and 24 and even the movable table segments are all fixed or held together as a more or less solid mass simply by tightening adjustment members such as the elevation members 35 and 43.) The degree of elevation effected is desirably limited or controlled by the use of one or more washers 36 and 44 as stop elements, but any other suitable means may be employed to limit elevational adjustment. The elevational adjustment of the table segments as a group is desired in order to change the brake to accommodate different thicknesses of material to be bent. The degree of needed elevational adjustment is relatively modest and normally will be but a fraction of an inch or fraction of a centimeter.

Since all table segments are substantially identical in dimension as viewed from an end (as in FIG. 2), the front edge 31 of table segment groupings can be adjusted in alignment distance from the axis 110 simply by adjusting the horizontal abutment members, e.g., the screws 37 and 45. They press on a vertical flange of angle irons 39 and 47, which in turn abuttingly presses on the vertical abuttable surface 30 of the right angle recesses in the legs 28. Screws 37 and 45 are threadedly mounted in foundation support rods 34 and 42. Here again, washers 38 and 46 may be employed to regulate the degree of horizontal sideways movement effected by the horizontal abutment screws 37 and 45 (i.e., those on one side being relaxed as those on the other side are tightened). In this manner, the horizontal sideways shift of the table segments 26 (in a direction transverse to the alignment of table segments), as caused by the action of the horizontal abutment screws on the vertical flanges of the angle irons 39 and 47, can be limited. Other stop means wholly distinct from washers, however, may be employed to give similar stop results and are embraced by the principles of this invention. The tightening of horizontal adjustment members is similar in effect to the tightening of elevational adjustment members in terms of stiffening and holding floating or slidable parts together as a more or less solid mass.

The primary significant fact is that table segments 26 are mounted in a manner permitting each table segment (or at least most of them) to be shifted, as by sliding movement in the linear direction of the aligned segments. This linear direction is parallel to the underlying elongated support system as well as the brake surface of the segments. The linear direction is also parallel to the axis-facing edge of the segments (i.e., the front edge 31 of the base assembly table segments 26). The mounting for linear movement of the table segments makes them movable in a direction parallel to their brake surface. Each is movable independently and separately of others in the most preferred embodiment. The fact of linear movement permits extraordinary compactness or lack of bulk for the design of the base assembly (as well as for the cover assembly and apron assembly). No longer is there any need for massive and significant heights for component portions of a base assembly capable of having its operable action brake surface varied. Indeed, despite the versatile adjustability built into the base assembly, its height can be almost nominal as a result of the new design. For example, an entire base assembly of the invention may be formed to have a height or vertical thickness or profile not in excess of about 5 centimeters or 2 inches (or even less for miniature brakes), with base assembly heights on the order of 10 cm. or about 4 in. suitable for handling even relatively challenging thicknesses of metal sheet material in bending operations. This is the more astonishing when one realizes that the length of the operable brake surface of the base assembly can be significantly varied for a variety of specific on-site bending operations.

Next to be discussed is the cover assembly.

The cover assembly 50 includes features common to those discussed for the base assembly. However, the table segments 56 for the cover assembly are inverted as compared to the table segments in the base assembly.

Like the base assembly, the cover assembly has a near end plate 52, a remote end plate 54, and a plurality of table segments 56 in a linear relationship or alignment between the near end 52 and remote end 54. The table segments suitably have a table plate 57 and leg plate 58. At least a majority and preferably all of the table segments 56 are individually movable in the linear direction of the alignment to space one or more of the table segments from others of the segments and thereby vary the number of table segments forming the operable action brake surface of the cover assembly. The length or bite of the table segments 56 in the direction parallel to the front edge 61 of those segments may vary as noted for the base assembly. Useful brakes of the invention may have their cover assembly as the sole assembly equipped with linearly adjustable table segments. Brakes having such a cover assembly are useful for upward bending of panels having flanged upward edges. Generally, however, the table segments in the cover assembly are arranged in the same pattern for bite size and position as in the base assembly.

The support system for the table segments 56 of the cover assembly is subordinate to (i.e., supportive to) the brake surface as in the base assembly. It is preferably comparable in all respects to that for the base assembly, and suitably comprises a central support rod or mount rod 62 on which the legs 58 of the table segments are mounted and may be fixed in position by a fixing screw 63. Lateral foundation support rods 64 and 72, like their base assembly counterparts, are equipped with a linear alignment of elevation screws or vertical adjustment screws 65 and 73, washers 66 and 74 for limiting the vertical adjustment of the screws 65 and 73, horizontal adjustment screws 67 and 75 as well as washers 68 and 76 for effecting transverse horizontal adjustment of the table segments 56. These adjustments are made to vary the front edge 61 location with respect to the axis 110 of the brake. Elongated abutment members (angle irons) 69 and 77 are in right angle abuttable recesses 59, 60 of the legs 58—all as discussed for the base assembly. The angle irons interestingly, as in the base assembly, are preferably not rigidly fixed to any part of the cover assembly. In other words, as in the base assembly, the angle irons preferably are floating and therefore are easily adjusted (and in turn adjust the table segments) in terms of their vertical and sideways movements by adjustment screws on the foundation support rods 64 and 72. In short, the entire illustrated support system and the results it provides conform to that discussed for the support system of the base assembly.

The cover assembly table segments 56 along the front 61 of their table plate portion 57 are preferably bevelled toward a point or acute angle. The apex of the acute angle is at the inverted or downward face of the table plate 57. This acute angle thus is at the front edge 61 most proximate to the axis 110 of the brake, and permits a bend of sheet material more or less upon itself (in that the angle of bend can be as sharp as the apex of the bevel).

The last of the three major assemblies is the apron.

The apron assembly 80 normally will be formed to have details of features and structures and functional relationships as discussed for the base assembly. The length of the apron assembly is defined by the near end plate 82 and the remote end plate 84. Between those end plates are the table segments 86 having table plates 87 and legs 88. At least a majority of table segments are individually movable in the linear direction of the alignment of them. (In the illustrated embodiment, all of them are.) The table segments may be spaced from each other, and in this manner, the number of table segments which are used or grouped to form the action brake surface can be varied. The axis-facing edge 91 of the table segments 86 of the apron is in proximate relationship to the front edge 31 of the base assembly (as well as the front edge 61 of the cover assembly during the usual bending operation).

The table segments are supported by a system subordinate to the brake surfaces of the segments (i.e., a system as discussed for the base and cover assemblies). This support system comprises rods, namely a support rod or mounting rod 92 on which table segments 86 are slidably mounted and on which each may be fixed by a fixing screw 93 extending through the bottom of the leg portion 88 of the table segment. Rod 92 is snugly but removably lodged in end plates 82 and 84. Other elements of the apron assembly are lateral foundation support rod 94, elevation screw 95, washers 96, horizontal adjustment screw 97, washers 98, floating elongated adjustment member or angle iron 99, and abuttable surfaces 89 and 90, plus the other lateral foundation support rod 102, elevation screws 103, washers 104, horizontal adjustment screws 105, washers 106, angle iron 107, and abuttable surfaces 89 and 90. These elements and their relationships and functions are as described for the base and cover assemblies.

Other features of the preferred embodiment will now be discussed.

Angle iron feet 113 and 114 may be provided for the base assembly. The end plates 22 and 24 of the base assembly may be fastened to such feet by bolts, welds, or other means.

The cover assembly 50 is most preferably hinged for a pivotable relationship to the base assembly 20. The most preferred hinging is solely at one end (such as the near end 22, 52) of the assemblies, with the axis of pivot for that hinging lying in a horizontal direction transverse to the length of the assemblies and transverse to the main axis of bend 110. While hinging at only one end is not critical, it is extremely desirable for brakes to be used in the bending of roofing panels. End hinging allows for quick clamping and unclamping of the brake or action surface of the table segments of the cover assembly on sheet material placed on the brake or action surface of the table segments of the base assembly. Useful hinging at the left end of the brake is illustrated in FIGS. 1 and FIG. 3, where a single hinge of an identical spaced pair is shown to comprise pin 115 uniting ears 48 on the end plate of the base assembly and an ear 78 on the end plate of the cover assembly. The other end or the remote right end 54 of the cover assembly is equipped with a latch 116 for releasable locking or holding the cover assembly 50 in relatively clamping relationship to the base assembly.

Each end 82, 84 of the apron assembly is pivotally mounted to each end 22, 24 of the base assembly by pin members 117 and 118 extending through holes in the respective end plates of the assemblies. The pins 117 and 118 are preferably easily removed from their hinging position so as to permit separation of the entire apron assembly from the remainder of the brake. This feature makes for easier porting or moving of the brake from one site to another. The axes of pivot 110 at these pin members 117, 118 extends parallel to and in proximate relationship to the front edge 31 of the table segments of the base assembly. It also is parallel to or substantially parallel to the front edge 61 of the inverted table segments of the cover assembly when the cover is clamped over the base assembly. The axis 110 also is parallel to and proximate to the axis-facing edge 91 of the table segments of the apron assembly.

Each foot 113 and 114 may be equipped with a side support flange 119 (see FIG. 2) to provide resting support for the end plates of the apron 80. A handle 120 in the nature of a lever may be fastened as by bolts or any other suitable means to the apron assembly, preferably at an end plate of it. The outwardly projecting arm of the handle provides a degree of leverage for arcing movement of the apron assembly about the main bend axis 110.

Consistent angulation for the bend of several different panels is made possible by using any suitable adjustable stop system for limiting the arc of movement of apron 80. For example, a slide rod 121 is mounted at pivot 121*a* in the flange of the angle iron foot 113. The slide rod 121 extends through a sleeve 122 pivotally mounted on end plate 82 of apron 80. The sleeve 122 is loose on rod 121 so as to permit easy slide of the rod through it. When the apron assembly 80 is upwardly arced, the sleeve 122 slides up the slide rod 121 and abuts a stop member 123, thereby limiting the arc of movement for the apron and the resulting angularity of bend in a sheet being bent. This angularity of bend can be repeatedly duplicated in any number of sheets. The stop member 123 suitably comprises a slidably adjustable sleeve and set screw for the sleeve.

A cantilever bar 126 with stress reinforcement 127 is preferably but optionally mounted on the cover assembly, and this is preferably accomplished in a manner allowing for easy dismantling of the cantilever bar from the cover assembly. A useful cantilever bar is equipped with a depending abutment projection 128 in the nature of a fulcrum projection underneath the cantilever bar for abutment against an end plate (near end plate 52) of the cover assembly 50. The remote end of the cantilever bar is removably fixed to the remote or other end plate 54 of the cover assembly by a removable pin 129 through a hole in a depending ear mass 130 on the remote end of the cantilever bar 126 and cooperating ear members 131 on the remote plate 54 of the cover assembly.

The local or near end of the cantilever bar extends beyond the fulcrum abutment 128 in an outward manner from the inner or near end plate 52 of the cover assembly, but the extension outwardly from the fulcrum abutment 128 is relatively short as compared to the total length of the cantilever bar between the fulcrum abutment 128 and its fixed mounting by removable pin 129 at the remote end plate 54 of the cover assembly.

Now to be described is the counterbalancing assembly, which in its most preferred form is an inertia-maintaining assembly. This assembly (see FIGS. 1 and 3) is contained within a housing having its upper part 136 fixed (as by screws) to its lower part 137 and has its lower part fixed (as by welds) to lateral mounting plates 138 (only one shown). Both lateral mounting plates have an outward vertical edge that abuts flush against the outer surface of the near or inner end plate 22 of the base assembly 20. Large ears 140 (only one shown) fixed to the near end plate 22 of the base assembly project outward in parallel relationship to each mounting plate 138. The mounting plates 138 and ears 140 are provided with mounting holes, and pins 142 (only one shown) easily removable are employed to hold the housing 137 solidly in position on the near end plate 22 of the base assembly.

The cantilever bar 126 at its end projecting outward from its fulcrum abutment 128 is counterbalanced in any suitable way, such as by forces such as pressure or weight applied on the projection. Any suitable body may serve as the point or mass for applying such pressure or weight. A roller 144 is useful. Illustratively, the cantilever bar 126 extends under and in upwardly pressing relationship against roller 144. As illustrated in FIG. 3, a grooved recess 146 may be provided in the upper surface of the cantilever bar for receipt of roller 144. Indeed, more than one groove may be provided in the upper surface. The roller may rest or be lodged in such recesses to hold the cantilever bar (and consequently the entire cover assembly) at preselected upward angles. Counterbalance forces on the cantilever bar may be applied on a sliding basis or on a fixed basis or on any other basis. The force may be provided by springs or weights or shifting masses. The force of counterbalance may be so great as to bias the entire cover assembly at a maximum upward angle, with the result that pressure on the cover assembly is required to push it into a clamping relationship with the base assembly and latch it to the base assembly.

The inertia-maintaining system particularly illustrated causes the cover assembly to stay in whatever angular relationship it is placed in, within the limits of the angular movement for it. Within the housing 136, 137 is a pneumatic or hydraulic system on each side of the cantilever bar 126. The system illustrated comprises one or more cylinders 148. Each cylinder 148 at its upper end has a projecting ear 150 with a hole in it through which a rod or bolt 152 is passed and fixed to housing 136. This arrangement fixes the position of the cylinders in the housing. From the lower end of each cylinder projects a ram or piston rod 154, and the piston rods are united at their outer or bottom end to a pin 156. Also fixed to the pin 156 are spaced holding bars 158, 159 which extend upward and are connected at their upper extremity by the axis shaft for the abutment roller 144. Suitable cylinders 148 for this inertia-maintaining system are called pneumatic spring cylinders and are commercially known and therefore need no detailed description. In essence, they are understood to have internal springs (or equivalent) pressing against the head end of a piston within them, plus internal passages for dampening shift of fluid (air or liquid) media between the upper and lower portion of the cylinders. This in turn dampens movement of the piston rod and the movement of the holding bars 158, 159 and the roller 144. The cantilever fulcrum axis may be at pivot pin 115 for the cover assembly; but the effective fulcrum between the portion of the cantilever bar extending over the cover assembly and the portion extending outwardly from the end plate 52 of the cover assembly to the roller is approximately at the depending fulcrum abutment 128 that abuts the end plate 52. Thus, the downward pressure of the roller 144 on the projecting end of the cantilever bar must approximately equal the weight carried by the longer length of cantilever bar extending over the cover assembly from the fulcrum abutment 128, if one is to achieve an inertia maintenance balance for the cover assembly. Inertia balance using cylinders in a system such as illustrated is desirable, but any counterbalancing that maintains the cover assembly in an upward tilt during times sheet material is positioned in or removed from the brake can be useful.

The latching system 116 (see FIGS. 4 and 5) for locking or holding the cover assembly in clamping relationship against the base assembly is exceedingly simple but effective for the holding or clamping desired.

Figure 5:
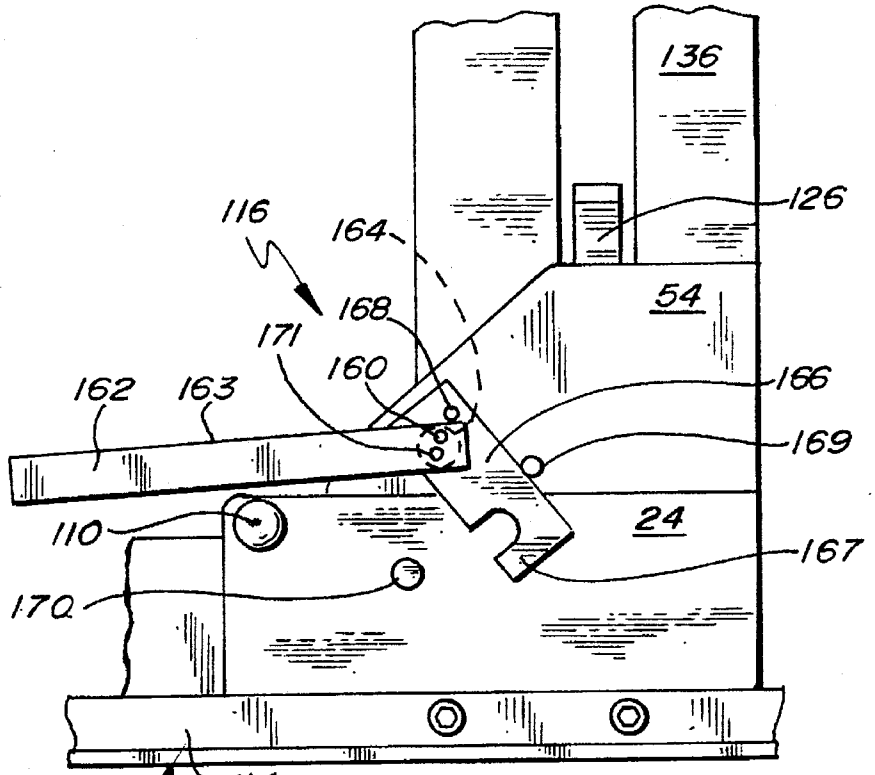
FIGS. 4 and 5 are schematic plan views of the remote end of the brake, particularly illustrating the preferred latching assembly in latched and unlatched condition, with other portions broken away.
Figure 4:
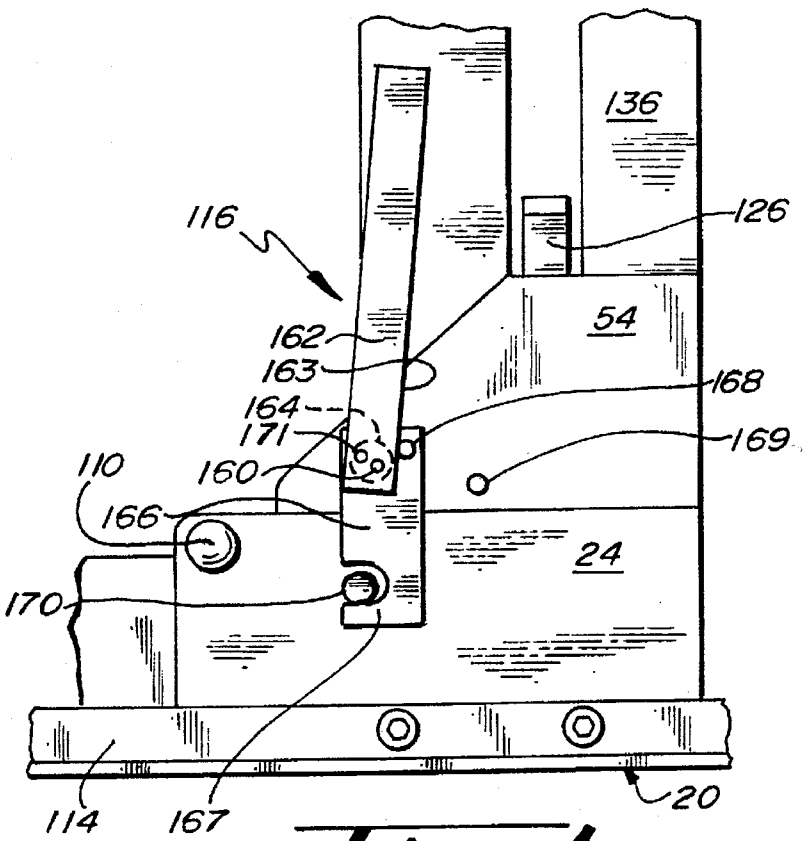

A key feature of the latch assembly is the pivot axis of its main pin 160. The shaft of the main axis pin 160 extends through the handle arm or lever 162 of the latch, then through a disk member 164 lodged in the body or thickness of the hook arm 166, and then is anchored in the outer or remote end plate 54 of the cover assembly. The hook arm body 166 has an outwardly projecting abutment pin 168 against which the adjacent end of the side edge 163 of the handle 162 abuts when the handle 162 is moved counterclockwise (to the "unhook" position as shown in FIG. 5). The counterclockwise motion of the handle causes adjacent edge 163 not only to abut pin 168 but also to act through pin 168 to move the hook arm 166 in a counterclockwise direction away from the outwardly projecting knob 170 fixed on the remote end plate 24 of the base assembly 20. But when the cover assembly is in position as illustrated in FIG. 4, or in a near position to that illustrated in FIG. 4, movement of the handle member 162 clockwise about main axis pin 160 (from the unlatched position of FIG. 5) effectively moves hook arm 166 clockwise to place hook 167 over the knob 170 of the base assembly 20. Continued clockwise motion of the latch handle 162 causes a proximate but different point on the adjacent side edge 163 of the handle member 162 to abut pin 168. The handle pressing against pin 168 effectively forces and maintains the hook 167 on the knob 170. Simultaneously, clockwise movement of handle 162 causes the hook 167 to be drawn upward into a tighter relationship on the knob by virtue of the fact that the hook arm 166 is itself (in its entirety) pivotally mounted on the internal disk 164. Its pivot mounting on disk 164 is by virtue of the fact that a cylindrical hole through hook arm 166 is occupied by the disk 164 and no other mounting is provided for the hook arm 166. What is interesting is the fact that disk 164 is fixed by anchor pin 171 to latch handle 162 so that the disk 164 and latch handle 162 move as a unit. The disk is lateral to the handle 162. The main axis pivot pin 160 is parallel to but eccentric to the center axis of the disk member 164. Therefore, when the disk 164 is rotated clockwise with the handle 162 about the main pivot axis 160, the final clockwise movement of the handle effectively pulls the entire hook arm 166 upwardly by virtue of the upward movement of the disk 164 caused by the lateral anchor pin 171 uniting the disk and handle for pivot at eccentric pivot 160. (The disk moves upward as the handle moves into the position illustrated in FIG. 4, and the reason it moves upward is because the disk itself pivots abut main axis 160 as handle 162 is moved.) A stop projection 169 on cover end plate 54 may be used to hold the latch assembly 116 in a stable position of unlatched rest.

In the most preferred embodiment of the invention, the sequence of bite size variations for the table segments of all three basic assemblies (i.e., base assembly, cover assembly, and apron assembly) should be essentially identical. In any event, when a roofing panel 190 having downward projecting edge flanges (as shown by dash lines in drawing) is to be bent upwardly, at least the grouping of table segments for the base assembly and the apron assembly (e.g., 86*a*, 86*b*, and 86*c*) should be in register or essentially identical. Where a roofing panel having upwardly extending flanges is to be bent upwardly, the critical table segment grouping is that for the cover assembly, and neither the base assembly nor the apron assembly need critically match or register with the grouping of the cover assembly. Varied groupings of table segments may provide the action brake surface of each assembly, depending on what may be needed to accommodate varied panel widths and flanges on the panels.

The invention also provides a system for quickly measuring the distance from an end of panel material to the place where a bend is to be placed in it. An illustrative measuring system (see FIG. 1) comprises a tubular yoke member 172 removably friction mounted on posts 174 fixed on foot members 113, 114 for the brake. The yoke 172 angles upward from the post foundation points but should remain (at its highest elevation) somewhat lower than the top surface (also called brake surface) of the apron table segments. Hollow, lightweight distance rods 176, 177 mounted on the yoke 172 extend horizontally outwardly away from the apron to an end foot member 178 which holds them in a substantially horizontal relationship. Each distance rod 176, 177 is equipped with a slidable sleeve 180, 181 that may be fixed in position by a set screw 182, 183. Therefore, a series of panels of one predetermined length to a bend location, as well as a series of panels of a different predetermined length to a bend location, may alternately be measured and bent using the bending brake. This provides great convenience (especially for roofers), since the need for individual measurement of each panel at the time of bending is simplified by virtue of the relatively automatic system for accomplishing each measurement using the measuring system.

Preparing the bending brake for on-site bending involves first moving or transporting the brake (either fully assembled or in various states of partial disassembly) to the bending site, assembling it if transported in partial disassembly, moving one or more linearly movable table segments to adjust the configuration of the brake surface of at least one of the major brake assemblies (i.e., the base assembly, cover assembly, and apron assembly), and—after adjusting to the configuration accommodating the panel to be bent—fixing the segments of that configuration against movement. Both elevational and transverse adjustments of the segments of the configuration may be done, as necessary to accommodate different thicknesses of sheet material subjected to bending (i.e., increased spacing from the main axis of bend—both horizontally and vertically or elevationally—as the sheet thickness increases). The active table segments for a bending operation are preferably centered between end plates of the major assemblies of the invention. The weight of the segments themselves does tend to cause some downward depression of the support rods. One may not desire to employ elevation adjustments to compensate for this. In fact, some such depression can give benefits in that slightly downwardly depressed segments of a cover assembly can function to hold sheet material against slippage on the table segments of the base assembly even before the cover assembly is fully latched to the base. Such holding action is beneficial to keep clumsy lengths of sheet or panel from sliding out of desired position for them in the brake.

Those skilled in the art will readily recognize that this invention may be embodied in still other specific forms than illustrated without departing from the spirit or essential characteristics of it. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

That which is claimed is:

1. An easily portable bending brake for on-site bending of architectural sheet metal panels, said brake comprising (i) a base assembly having opposing ends and an upward segmented brake surface between said ends, one said end of said base assembly being a near end and the other being a remote end, said base assembly brake surface being formed by a linear alignment of a polarity of table segments each having a table plate and a support leg perpendicular to the table plate, an elongated support system to which said legs of said table segments are mounted in a manner permitting linear movement of the table segments in the direction of said alignment, and fixing means for fixing said linearly movable table segments against linear movement, (ii) a cover assembly having a near end and a remote end and a downward brake surface therebetween, said cover assembly being above said base assembly, said near end of said cover assembly being hinged to said near end of said base assembly for pivotal movement of said cover assembly into and out of a clamping relationship with said base assembly in a manner involving movement of said remote end of said cover assembly toward and away from the remote end of said base assembly, (iii) means for latching said remote end of said cover assembly to the remote end of said base assembly, and (iv) an apron assembly having opposing ends and an upward brake surface between said ends, said apron assembly being mounted at each end thereof to each end of said base assembly for pivotal movement of said apron assembly with respect to said base assembly in performing a bending operation on material clamped between said brake surfaces of said cover assembly and base assembly, said cover assembly brake surface being formed by a linear alignment of a plurality of table segments, an elongated support system to which said table segments are mounted in a manner permitting linear movement of the table segments in the direction of said alignment, and fixing means for fixing said linearly movable table segments against linear movement.

2. The brake of claim 1 additionally comprising means for adjusting said linearly movable table segments of said base assembly in a direction which is transverse to said linear direction of said segments and substantially parallel to the brake surface of said table segments of said base assembly.

3. The brake of claim 1 wherein said elongated support system of said base assembly comprises more than one support rod.

4. The brake of claim 1 additionally comprising a cantilever bar extending outward from the near end of said cover assembly, and a counterbalancing force applied to the outward portion of said cantilever bar.

5. The brake of claim 1 additionally comprising counterbalance means for counterbalancing said cover assembly in a pivot position above said base assembly.

6. The brake of claim 1 additionally including stop means for limiting the pivot movement of said apron assembly.

7. The brake of claim 1 additionally including elongated measuring means entirely separate from said apron assembly and extending horizontally outward from a central location between said ends of said apron assembly for measuring a predetermined length of panel, said elongated measuring means including a foot member at the outward end thereof for supporting said outward end, and adjustable stop means against which one end of a panel may be abutted during measurement of the length of panel from that panel end to the location where a bend is to be placed in the panel.

8. The brake of claim 1 wherein said cover assembly additionally comprises a support rod extending subordinate to said brake surface between said ends of said cover assembly, said brake surface of said cover assembly comprising linearly movable table segments mounted for linear movement to different locations along said support rod, and means for fixing said movable table segments against movement along said support rod.

9. The brake of claim 1 wherein said table segments of said apron assembly each comprises a table plate and a support leg.

10. The brake of claim 8 wherein said table segments of said cover assembly comprise a table plate and a support leg.

11. A method of preparing a bending brake for on-site bending, comprising (i) transporting to the bending site the elements of a bending brake comprising a base assembly having an upward brake surface, a cover assembly having a downward brake surface for movement into and out of a clamping relationship with said upward brake surface of said base assembly, and an apron assembly having an upward brake surface for bending material clamped between the brake surfaces of said cover assembly and said base assembly, at least said apron assembly being disconnected from other elements of said brake during said transport and connected to said base assembly for the on-site bending operations, at least one of said assemblies comprising a support member and a linear alignment of a plurality of movable table segments forming the brake surface of said one assembly, said table segments being mounted with said support member extending therethrough in a manner precluding each segment from being transversely demounted from said linear alignment, said segments being slidably movable in the linear direction of said alignment, (ii) moving one or more of said movable table segments on said support member in the linear direction of said alignment to thereby adjust the configuration of the brake surface of said one assembly, (iii) fixing said segments of said configuration against linear movement on said support member, and (iv) providing in said one assembly a foundation member in addition to said support member and adjusting said linearly movable table segments by shifting said segments in a lateral direction with respect to said foundation member, the relationship of said foundation member to said support member being such that movement of said support member during a bending operation causes equal movement of said foundation member.

12. A bending brake comprising three assemblies, namely a base assembly having a near end and a remote end and an upward brake surface between said ends, a cover assembly having a near end and a remote end and a downward brake surface therebetween, said cover assembly being above said base assembly and having its near end hinged to paid base assembly, said downward brake surface of said cover assembly being movable into and out of a clamping relationship with said upward brake surface of said base assembly in a manner involving movement of said remote end of said cover assembly toward and away from the remote end of said base assembly, and an apron assembly mounted for pivotal movement with respect to said base assembly and having an upward brake surface for performing a bending operation on material clamped between said brake surfaces of said cover assembly and said base assembly, the brake surface of each of said three assemblies being formed by linearly movable table segments, said table segments of each said assembly consisting essentially of a table means supported by leg means, an elongated support system for each said assembly, said table segments of each said assembly being mounted at said leg means thereof to said elongated support system in a manner permitting linear sliding movement along said support system to locations entirely vacated by a said segment, and each said assembly having means for fixing said movable table segments thereof against said linear sliding movement.

13. A bending brake comprising three assemblies, namely a base assembly having an upward brake surface, a cover assembly having a downward brake surface above said base assembly, said downward brake surface of said cover assembly being movable into and out of a clamping relationship with said upward brake surface of said base assembly, and an apron assembly mounted for pivotal movement with respect to said base assembly and having an upward brake surface, said apron assembly being pivotally movable about its mounting in performing a bending operation on material clamped between said brake surfaces of said cover assembly and said base assembly, the brake surface of at least one of said three assemblies comprising a linear alignment of a plurality of movable table segments that can be moved in the linear direction of said alignment, each said table segment of said one assembly being mounted on said one assembly so as to be not transversely demountable from said linear alignment, wherein said linear alignment lies between a near end and a remote end of said one assembly and each of the other two assemblies has a near end proximate to the near end of said one assembly and a remote end proximate to the remote end of said one assembly, and wherein said near end of said cover assembly is hinged to the near end of said base assembly for pivotal movement of said remote end of said cover assembly toward and away from the remote end of said base assembly.

14. The brake of claim 13 wherein said remote end of said cover assembly is equipped with a latch for latching said remote end to said base assembly, and means for adjusting the elevation of the brake surface of said one assembly.

15. The brake of claim 13 additionally comprising a cantilever bar extending outward from the near end of said cover assembly, and a counterbalancing force applied to the outward portion of said cantilever bar, and means for adjusting the elevation of the brake surface of said one assembly.

16. A bending brake comprising three assemblies, namely a base assembly having an upward brake surface, a cover assembly having a downward brake surface above said base assembly, said downward brake surface of said cover assembly being movable into and out of a clamping relationship with said upward brake surface of said base assembly, and an apron assembly mounted for pivotal movement with respect to said base assembly and having an upward brake surface, said apron assembly being pivotally movable about its mounting in performing a bending operation on material clamped between said brake surfaces of said cover assembly and said base assembly, the brake surface of at least one of said three assemblies comprising a linear alignment of a plurality of movable table segments that can be moved in the linear direction of said alignment, each said table segment of said one assembly being mounted on said one assembly so as to be not transversely demountable from said linear alignment, said brake additionally comprising counterbalance means for counterbalancing said cover assembly above said base assembly, and means for adjusting the elevation of the brake surface of said one assembly.

17. A bending brake comprising:

(i) a base assembly having opposing end members, an upward facing brake surface, a support rod extending subordinate to said brake surface between said end members, said brake surface comprising a plurality of movable table segments mounted on said support rod in a manner permitting linear sliding movement of each segment to a variety of different locations along said support rod, including locations vacated by linearly sliding a different said segment therefrom, and means for fixing said movable table segments against movement along said support rod, (ii) a cover assembly having opposing end members, a downward facing brake surface above said base assembly, said cover assembly being hinged at an end thereof to an end of said base assembly for pivot movement of said cover assembly into and out of a clamping relationship to said base assembly, and (iii) an apron assembly having opposing end members and an upward facing brake surface, said apron assembly being hinged at each end thereof to each end of said base assembly for pivot movement of the brake surface of said apron assembly arcuately toward the brake surface of said base assembly in performing a bending operation on material clamped between said brake surfaces of said cover assembly and said base assembly.

18. The brake of claim 17 wherein said cover assembly additionally comprises a support rod extending subordinate to said brake surface between said end members of said cover assembly, said brake surface of said cover assembly comprising movable table segments mounted on said support rod in a manner such that said support rod extends through said table segments and allows said table segments to be linearly moved to different locations along said support rod, and means for fixing said movable table segments against movement along said support rod.

19. The brake of claim 17 wherein said apron assembly additionally comprises a support rod extending subordinate to said brake surface between said end members of said apron assembly, said brake surface of said apron assembly comprising movable table segments mounted on said support rod in a manner such that said support rod extends through said table segments and allows said table segments to be linearly moved to different locations along said support rod, and means for fixing said movable table segments against movement along said support rod.

20. A method of preparing a bending brake for on-site bending, comprising (i) transporting to the bending site the elements of a bending brake comprising a base assembly having an upward brake surface, a cover assembly having a downward brake surface for movement into and out of a clamping relationship with said upward brake surface of said base assembly, and an apron assembly having an upward brake surface for bending material clamped between the brake surfaces of said cover assembly and said base assembly, at least said apron assembly being disconnected from other elements of said brake during said transport and connected to said base assembly for the on-site bending operations, at least one of said assemblies comprising a support member and a linear alignment of a plurality of movable table segments forming the brake surface of said one assembly, said table segments being mounted with said support member extending therethrough in a manner precluding each segment from being transversely demounted from said linear alignment, said segments being slidably movable in the linear direction of said alignment, (ii) moving one or more of said movable table segments on said support member in the linear direction of said alignment to thereby adjust the configuration of the brake surface of said one assembly, and (iii) fixing said segments of said configuration against linear movement on said support member.

21. The method of claim 20 additionally comprising the step of providing in said one assembly a foundation member in addition to said support member and adjusting the elevation of said linearly movable table segments with respect to said foundation member.

22. The method of claim 20 additionally comprising the step of providing in said one assembly a foundation member in addition to said support member and adjusting said linearly movable table segments by shifting said segments in a lateral direction with respect to said foundation member.

23. A bending brake comprising a base assembly having an upward brake surface, a cover assembly above said base assembly, said cover assembly having a downward brake surface movable into and out of a clamping relationship with said upward brake surface of said base assembly, and an apron assembly pivotally hinged to said base assembly and having an upward brake surface for bending material clamped between said brake surfaces of said cover assembly and said base assembly, the brake surface of at least one of said assemblies comprising a linear alignment of a plurality of movable table segments mounted on a support rod in a manner such that said support rod extends through said table segments and allows said table segments to be slidably moved along said support rod in the linear direction of said alignment and does not allow demountability of said segments transversely from said linear alignment.

24. A bending brake comprising a base assembly having an upward brake surface, a cover assembly above said base assembly, said cover assembly having a downward brake surface movable into and out of a clamping relationship to said upward brake surface of said base assembly, and an apron assembly pivotally hinged to said base assembly and having an upward brake surface, the brake surface of at least one of said assemblies comprising a linear alignment of a plurality of movable table segments that can be moved in the linear direction of said alignment, each said table segment having an abuttable surface subordinate to said brake surface, said one assembly additionally comprising a mounting rod extending through said linearly movable table segments in a manner permitting sliding movement of said table segments on said mounting rod, opposing end members to which said mounting rod is mounted, a foundation rod extending substantially parallel to said mounting rod, said foundation rod being fixed at the ends thereof to said end members, a floating elongated abutment member in parallel relationship to said foundation rod and in mating abutment against said table segment abuttable surfaces, and elevation adjustment members lodged in said foundation rod for applying elevational pressure on said floating member and ultimately on said table segments through said abuttable surfaces abutted by said floating member, to thereby vary the elevation of said table segments with respect to said foundation rod.

25. A bending brake comprising a base assembly having an upward brake surface, a cover assembly above said base assembly, said cover assembly having a downward brake surface movable into and out of a clamping relationship to said upward brake surface of said base assembly, and an apron assembly pivotally hinged to said base assembly and having an upward brake surface, at least one of said assemblies comprising a mounting rod and a linear alignment of a plurality of table segments for forming the brake surface of said one assembly, each said table segment having an opening through which said mounting rod extends in a manner precluding transverse demountability of said segments therefrom, said table segments being slidably movable to different locations along said mounting rod, and means for fixing said table segments against sliding movement along said mounting rod.

26. A bending brake comprising three assemblies, namely a base assembly having an upward brake surface, a cover assembly having a downward brake surface above said base assembly, said downward brake surface of said cover assembly being movable into and out of a clamping relationship with said upward brake surface of said base assembly, and an apron assembly mounted for pivotal movement with respect to said base assembly and having an upward brake surface, said apron assembly being pivotally movable about its mounting in performing a bending operation on material clamped between said brake surfaces of said cover assembly and said base assembly, the brake surface of at least one of said three assemblies comprising a linear alignment of a plurality of movable table segments that can be moved in the linear direction of said alignment, each said table segment of said one assembly being mounted on said one assembly so as to be not transversely removable from said linear alignment, and additionally comprising means for adjusting said linearly movable table segments in a direction which is transverse to said linear direction and substantially parallel to the brake surface of said table segments of said linear alignment.

27. A bending brake comprising three assemblies, namely a base assembly having an upward brake surface, a cover assembly having a downward brake surface above said base assembly, said downward brake surface of said cover assembly being movable into and out of a clamping relationship with said upward brake surface of said base assembly, and an apron assembly mounted for pivotal movement with respect to said base assembly and having an upward brake surface, said apron assembly being pivotally movable about its mounting in performing a bending operation on material clamped between said brake surfaces of said cover assembly and said base assembly, the brake surface of at least one of said three assemblies comprising a linear alignment of a plurality of movable table segments that can be moved in the linear direction of said alignment, each said table segment of said one assembly being mounted on said one assembly so as to be not transversely removable from said linear alignment, wherein said one assembly additionally comprises a mounting rod on which said linearly movable table segments of said one assembly are mounted in a manner allowing for movement along said rod, said brake additionally comprising a foundation support rod spaced on each side of said mounting rod and extending substantially parallel to said mounting rod, an elongated abutment member in parallel and proximate relationship to each said foundation support rod, abuttable surfaces on said table segments against which said elongated abutment members abut, and elevational adjustment members extending between said foundation support rods and said elongated abutment members for acting on said table segment abuttable surfaces through said elongated abutment members to effect incremental variation of the elevation of said table segments with respect to said foundation support rods.

28. A bending brake comprising three assemblies, namely a base assembly having an upward brake surface, a cover assembly having a downward brake surface above said base assembly, said downward brake surface of said cover assembly being movable into and out of a clamping relationship with said upward brake surface of said base assembly, and an apron assembly mounted for pivotal movement with respect to said base assembly and having an upward brake surface, said apron assembly being pivotally movable about its mounting in performing a bending operation on material clamped between said brake surfaces of said cover assembly and said base assembly, the brake surface of at least one of said three assemblies comprising a linear alignment of a plurality of movable table segments that can be moved in the linear direction of said alignment, each said table segment of said one assembly being mounted on said one assembly so as to be not transversely removable from said linear alignment, wherein said one assembly additionally comprises a mounting rod on which said linearly movable table segments of said one assembly are mounted in a manner allowing for movement along said rod, and said linearly movable table segments are relatively snugly mounted for sliding movement on said mounting rod and have abuttable surfaces subordinate to said brake surfaces thereof, and wherein said one assembly additionally comprises opposing end members to which said mounting rod is mounted, a foundation rod extending substantially parallel to said mounting rod, said foundation rod being fixed at the ends thereof to said end members of said one assembly, a floating elongated abutment member in parallel relationship to said foundation rod and in mating abutment against said table segment abuttable surfaces, and elevation adjustment members lodged in said foundation rod for applying elevational pressure on said floating member and ultimately on said table segments through said abuttable surfaces abutted by said floating member, to thereby vary the elevation of said table segments with respect to said foundation rod and to thereby simultaneously vary, through said table segments, the elevational stress applied on said mounting rod from said foundation rod.

29. A bending brake comprising three assemblies, namely a base assembly having an upward brake surface, a cover assembly having a downward brake surface above said base assembly, said downward brake surface of said cover assembly being movable into and out of a clamping relationship with said upward brake surface of said base assembly, and an apron assembly mounted for pivotal movement with respect to said base assembly and having an upward brake surface, said apron assembly being pivotally movable about its mounting in performing a bending operation on material clamped between said brake surfaces of said cover assembly and said base assembly, the brake surface of at least one of said three assemblies comprising a linear alignment of a plurality of movable table segments that can be moved in the linear direction of said alignment, each said table segment of said one assembly being mounted on said one assembly so as to be not transversely removable from said linear alignment, wherein said one assembly additionally comprises a mounting rod on which said linearly movable table segments of said one assembly are mounted in a manner allowing for movement along said rod, and said linearly movable table segments are relatively snugly mounted for sliding movement on said mounting rod and have abuttable surfaces on each lateral side of said mounting rod, said abuttable surfaces on each said side comprising a substantially horizontal abuttable surface and a substantially vertical abuttable surface, and wherein said one assembly additionally comprises opposing end members in which the ends of said mounting rod are removably lodged, and an adjustable support system on each lateral side of said mounting rod, said adjustable support system on one said lateral side comprising a foundation rod laterally spaced from and extending substantially parallel to said mounting rod, said foundation rod being fixed at the ends thereof to said end members of said one assembly, a floating elongated abutment member in parallel relationship to said foundation rod and in mating abutment against said table segment abuttable surfaces on said one lateral side, elevation adjustment members lodged in said foundation rod for applying elevational pressure on said floating member and therefore also on the substantially horizontal abuttable surface of said table segments abutted by said floating member, to thereby vary the elevation of said table segments with respect to said foundation rod and to thereby simultaneously vary, through said table segments, the elevational tension applied on said mounting rod from said foundation rod, and horizontal adjustment members lodged in said foundation rod for applying horizontal pressure on said floating member and therefore also on the substantially vertical abuttable surface of said table segments abutted by said floating member, to thereby vary the horizontal position of said table segments with respect to said foundation rod and to thereby simultaneously vary, through said table segments, the horizontal tension applied on said mounting rod from said foundation rod; said floating elongated abutment member as well as said mounting rod being held against dislodgement from said one assembly when either said elevation adjustment members or said horizontal adjustment members are placed in pressing condition on said floating adjustment member.

30. A bending brake comprising three assemblies, namely a base assembly having an upward brake surface, a cover assembly having a downward brake surface above said base assembly, said downward brake surface of said cover assembly being movable into and out of a clamping relationship with said upward brake surface of said base assembly, and an apron assembly mounted for pivotal movement with respect to said base assembly and having an upward brake surface, said apron assembly being pivotally movable about its mounting in performing a bending operation on material clamped between said brake surfaces of said cover assembly and said base assembly, the brake surface of at least one of said three assemblies comprising a linear alignment of a plurality of movable table segments that can be moved in the linear direction of said alignment, each said table segment of said one assembly being mounted on said one assembly so as to be not transversely removable from said linear alignment, wherein said linear alignment lies between a near end and a remote end of said one assembly and each of the other two assemblies has a near end proximate to the near end of said one assembly and a remote end proximate to the remote end of said one assembly, wherein said near end of said cover assembly is hinged to the near end of said base assembly for pivotal movement of said remote end of said cover assembly toward and away from the remote end of said base assembly, and additionally comprising a latch for latching the remote end of said cover assembly to said base assembly, said latch comprising a handle lever fixed laterally to a disk member and pivotable at an axis pin parallel to and eccentric to the axis of said disk member such that pivot movement of said handle lever in one direction serves to lower said disk member and pivot movement of said handle lever in the opposite direction tends to elevate said disk member, said axis pin being mounted in said remote end of said cover assembly, and a hook member mounted on said disk member in a manner such that elevation and lowering of said disk member effectively elevates and lowers said hook member for latching and unlatching.

* * * * *